US008779338B2

(12) United States Patent
Jeanneteau et al.

(10) Patent No.: US 8,779,338 B2
(45) Date of Patent: Jul. 15, 2014

(54) METHOD AND APPARATUS FOR CONTROLLING A COOKING DEVICE, IN PARTICULAR AN INDUCTION HOB

(75) Inventors: Laurent Jeanneteau, Compiegne (FR); Erik Svend Christiansen, Faenza (IT); Thibaut Rogolle, Forli (IT); Massimo Zangoli, Santercangelo di Romagna (IT); Mario Barocci, Cesena (IT)

(73) Assignee: Electrolux Home Products Corporation N.V., Zaventem (BE)

( * ) Notice: Subject to any disclaimer, the term of this patent is extended or adjusted under 35 U.S.C. 154(b) by 718 days.

(21) Appl. No.: 12/744,406

(22) PCT Filed: Oct. 8, 2008

(86) PCT No.: PCT/EP2008/008477
§ 371 (c)(1),
(2), (4) Date: May 24, 2010

(87) PCT Pub. No.: WO2009/068133
PCT Pub. Date: Jun. 4, 2009

(65) Prior Publication Data

US 2010/0252549 A1 Oct. 7, 2010

(30) Foreign Application Priority Data

Nov. 28, 2007 (EP) ..... 07023014

(51) Int. Cl.
*H05B 6/04* (2006.01)

(52) U.S. Cl.
USPC ..... 219/660; 219/485

(58) Field of Classification Search
CPC ..... F24C 7/987; F24C 15/105
USPC ..... 219/620, 660, 485, 486; 700/306, 299
See application file for complete search history.

(56) References Cited

U.S. PATENT DOCUMENTS 2,110,727 A 3/1938 Otto et al.
5,808,280 A 9/1998 Gaspard
(Continued)

FOREIGN PATENT DOCUMENTS

DE 666554 10/1938
DE 3815686 * 11/1989 ..... H05B 6/06
(Continued)

OTHER PUBLICATIONS

Translation or Gehrke (DE3815686 A) (Nov. 1989) 2 pages.*
(Continued)

*Primary Examiner* — Caridad Everhart
(74) *Attorney, Agent, or Firm* — Pearne & Gordon LLP

(57) ABSTRACT

The present invention relates to a method for controlling a cooking device, in particular an induction hob. The method comprises the steps of activating an overload power ($P_{OVER}$) for at least one electric or electronic component of the cooking device by using at least two synchronized generators, which overload power ($P_{OVER}$) is greater than a standard maximum power ($P_{MAX}$), deactivating the overload power ($P_{OVER}$) after a predetermined period ($\Delta t$), and operating the cooking device at a power (P), which is at most the standard maximum power ($P_{MAX}$). The standard maximum power ($P_{MAX}$) is provided for a permanent operation of the cooking device. The overload power ($P_{OVER}$) and/or the period ($\Delta t$) are determined by a function depending on at least the overload power ($P_{OVER}$) and the period ($\Delta t$). The present invention relates further to a corresponding apparatus for controlling a cooking device, in particular an induction hob.

15 Claims, 1 Drawing Sheet

(56) References Cited

U.S. PATENT DOCUMENTS

| | | | | |
|---|---|---|---|---|
| 6,498,325 | B1 * | 12/2002 | Akel et al. | 219/624 |
| 2001/0001465 | A1 * | 5/2001 | Inoh et al. | 219/646 |
| 2005/0173401 | A1 * | 8/2005 | Bakanowski et al. | 219/412 |
| 2006/0237450 | A1 * | 10/2006 | Uchida et al. | 219/662 |
| 2010/0181301 | A1 * | 7/2010 | Gutierrez | 219/620 |

FOREIGN PATENT DOCUMENTS

| | | | | |
|---|---|---|---|---|
| GB | 804453 | | 11/1958 | |
| JP | 06-284963 A | * | 10/1994 | A47J 27/00 |
| JP | 2004-079400 A | * | 3/2004 | |

OTHER PUBLICATIONS

Translation of Gehrke (DE3815686 A) (Nov. 1989), 10 pages.*
Abstract of JP 06-284963 A(Fujimoto) (Oct. 11, 1994) 2 pages.*
Abstract of JP 2004-079400(Mitsubishi Denko) (Mar. 11, 2004) 2 pages.*
Translation of JP 06-284963 A (Fujimoto) (Oct. 11, 1994), 3 pages.*
International Search Report for PCT/EP2008/08477, dated Feb. 17, 2009, 2 pages.

* cited by examiner

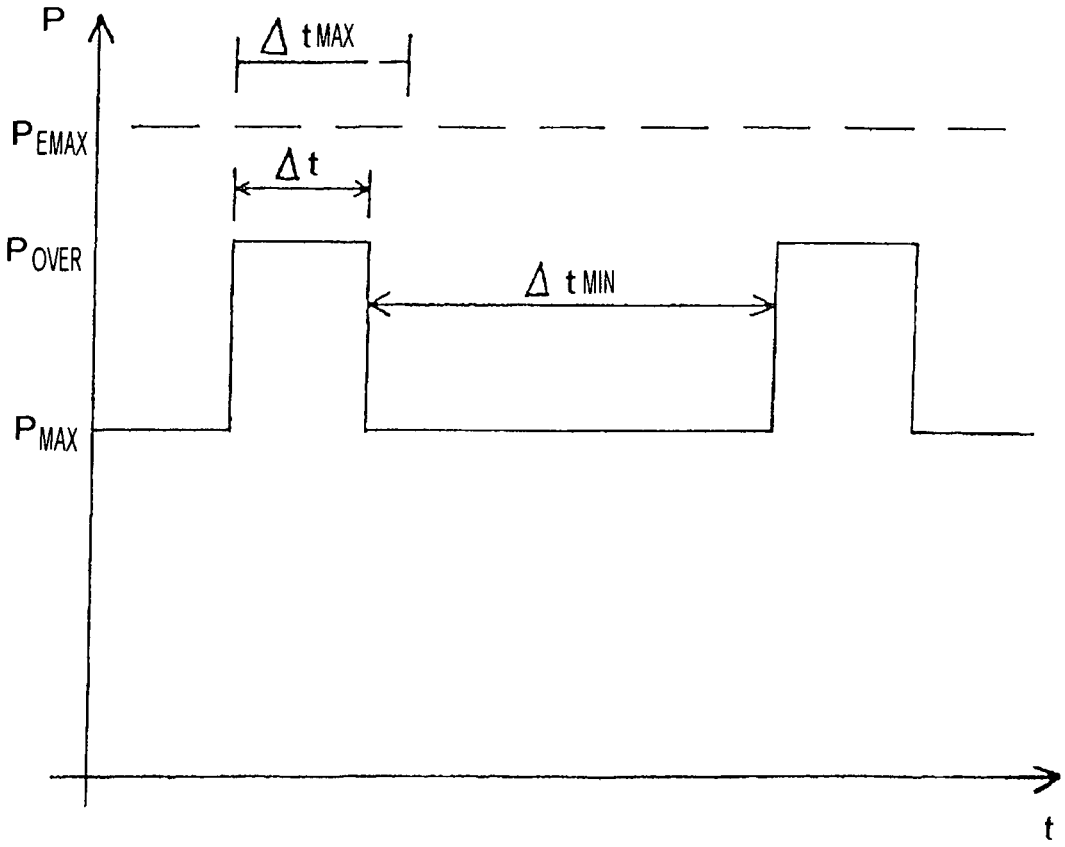
P
Δ t MAX
P EMAX
Δ t
P OVER
Δ t MIN
P MAX
t

METHOD AND APPARATUS FOR CONTROLLING A COOKING DEVICE, IN PARTICULAR AN INDUCTION HOB

The present invention relates to a method for controlling a cooking device, in particular an induction hob according to claim 1. Further, the present invention relates to an apparatus for controlling a cooking device, in particular an induction hob according to claim 10.

Modern induction hobs have large cooking zones. These cooking zones require a lot of electric power. In the most countries the power supply is standardized. Usually, in Europe the electric voltage is 230 V and the current is limited to 16 A. This results in a maximum electric power of 3680 W of one module. Thus, the power of the electric energy is limited to about between 3.6 kW and 3.7 kW.

The induction hobs available on the market use typically at least two modules, wherein each module is provided by two generators. In some configurations two generators are coupled on one cooking area. The two modules are coupled together in order to be able to provide more power, e.g. 4 kW and more. This configuration requires additional switching components and a complex circuitry. At the same time the use of the two modules is limited.

It is an object of the present invention to provide a method and an apparatus for controlling a cooking device, which allow an increased power without additional components.

This object is achieved by the method according to claim 1.

According to the present invention the method for controlling a cooking device, in particular an induction hob comprises the following steps:

- activating an overload power for at least one electric or electronic component of the cooking device by using at least two synchronized generators, which overload power is greater than a standard maximum power,
- deactivating the overload power after a predetermined period, and
- operating the cooking device at a power, which is at most the standard maximum power, wherein
- the standard maximum power is provided for a permanent operation of the cooking device, and wherein
- the overload power and/or the period are determined by a function depending on at least the overload power and the period.

The main idea of the invention is to overload some electronic components by an increased power for a limited time by using at least two synchronized generators. The maximum power on the one hand and the limited time on the other hand are configured in such a way that the electric and/or electronic components will not be destroyed. For the inventive method no additional components are required. In particular, the inventive method requires no additional components for combining the generators.

Preferably, the standard maximum power is determined by the properties of a voltage source. This avoids problems in the power supply.

For example, the overload power and/or the period are determined by an integral of the overload power over the period. This integral corresponds with the loadings of the electric or electronic components of the cooking device.

Further, the overload power and/or the period depend on at least one maximum temperature. The maximum temperature may depend on the properties of the electric and/or electronic component of the cooking device.

In order to avoid the destruction of electric and/or electronic components the overload power may be limited by an extended maximum power.

Additionally, the period is limited by a maximum period. This avoids also the destruction of electric and/or electronic components.

In a similar way a minimum period between the step of deactivating the overload power and a later step of activating an overload power again is provided.

The invention relates further to a computer program product stored on a computer usable medium, comprising computer readable program means for causing a computer to perform the method described above.

The object of the invention is further achieved by the apparatus according to claim 10.

According to the invention the apparatus for controlling a cooking device, in particular an induction hob is provided for:

- activating an overload power for at least one electric or electronic component of the cooking device by using at least two synchronized generators, which overload power is greater than a standard maximum power,
- deactivating the overload power after a predetermined period, and
- operating the cooking device at a power, which is at most the standard maximum power, wherein
- the standard maximum power is provided for a permanent operation of the cooking device, and wherein
- the overload power and/or the period are determined by a function depending on at least the overload power and the period.

The apparatus of the invention allows overloading some electronic components of the cooking device for a limited time. This results in an increased power for the cooking device or the induction hob, respectively.

The inventive apparatus is realized in hardware, software or a combination of hardware and software.

In particular, the apparatus is provided for the method as described above.

At last, a computer program product is provided. Said computer program product is stored on a computer usable medium, comprising computer readable program means for causing a computer to perform the method described above.

The novel and inventive features believed to be the characteristic of the present invention are set forth in the appended claims.

The invention will be described in further detail with reference to the drawing, in which FIG. 1 illustrates a schematic timing diagram of a method for FIG. 1 illustrates a schematic timing diagram of the power for an induction hob according to a preferred embodiment of the invention.

In FIG. 1 a schematic timing diagram of the power P for an induction hob according to a preferred embodiment of the invention is illustrated. The power P is shown as a function of the time t. In the beginning the induction hob operates with a standard maximum power $P_{MAX}$. In this operation mode there is no danger that the induction hob or a voltage supply will be destroyed. The dangerous values of the power are above the standard maximum power $P_{MAX}$. However, the standard maximum power $P_{MAX}$ may be exceeded for a limited time.

After the operation with the standard maximum power $P_{MAX}$, an overload power $P_{OVER}$ is activated and the power increases for a limited period $\Delta t$. By way of precaution a maximum period $\Delta t_{MAX}$ is defined in order to obtain an upper limit for the period $\Delta t$. This is an additional action for avoiding any destructions of the induction hob or the voltage supply.

When the period $\Delta t$ is over, the induction hob operates with the standard maximum power $P_{MAX}$ again. In general, the induction hob may operate with a power, which is less than or equal with the standard maximum power $P_{MAX}$ during this time.

After a minimum period $\Delta t_{MIN}$ the overload power $P_{OVER}$ is activated again and the power increases for a further limited period $\Delta t$. The minimum period $\Delta t_{MIN}$ is defined between the step of deactivating the overload power $P_{OVER}$ and a later step of activating an overload power $P_{OVER}$ again. The minimum period $\Delta t_{MIN}$ is also introduced by way of precaution into the preferred embodiment of the invention.

Further the overload power $P_{OVER}$ is limited by an extended maximum power $P_{EMAX}$.

At last, a maximum temperature T is defined, which depends on the properties of at least one electric or electronic component of the cooking device. The temperatures T within the susceptible electric or electronic components of the cooking device are detected. If the temperature T within one of the susceptible electric or electronic components excesses a predetermined value, then the overload power $P_{OVER}$ will be deactivated.

The present invention can also be embedded in a computer program product, which comprises all the features enabling the implementation of the method described herein. Further, when loaded in a computer system, said computer program product is able to carry out these methods.

Although illustrative embodiments of the present invention have been described herein with reference to the accompanying drawing, it is to be understood that the present invention is not limited to those precise embodiments, and that various other changes and modifications may be affected therein by one skilled in the art without departing from the scope or spirit of the invention. All such changes and modifications are intended to be included within the scope of the invention as defined by the appended claims.

| List of reference numerals | |
|---|---|
| P | power |
| $P_{OVER}$ | overload power |
| $P_{MAX}$ | standard maximum power |
| $P_{EMAX}$ | extended maximum power |
| t | time |
| $\Delta t$ | period |
| $\Delta t_{MAX}$ | maximum period |
| $\Delta t_{MIN}$ | minimum period |
| T | temperature |
| $T_{MAX}$ | maximum temperature |

The invention claimed is:

1. A method for controlling a cooking device, in particular an induction hob, which method comprises the following steps:

activating an overload power ($P_{OVER}$) for at least one electric or electronic component of the cooking device by using at least two synchronized generators, which overload power ($P_{OVER}$) is greater than a standard maximum power ($P_{MAX}$);

deactivating the overload power ($P_{OVER}$) after a predetermined period ($\Delta t$); and operating the cooking device at a power (P), which is at most the standard maximum power ($P_{MAX}$); wherein the standard maximum power ($P_{MAX}$) is provided for a permanent operation of the cooking device, the overload power ($P_{OVER}$) and/or the period ($\Delta t$) are determined by a function depending on at least the overload power ($P_{OVER}$) and the period ($\Delta t$), and no additional components are required during activation of the overload power ($P_{OVER}$).

2. The method according to claim 1, wherein the standard maximum power ($P_{MAX}$) is determined by the properties of a voltage source that is associated with the cooking device.

3. The method according to claim 1, wherein the overload power ($P_{OVER}$) and/or the period ($\Delta t$) are determined by an integral of the overload power ($P_{OVER}$) over the period ($\Delta t$).

4. The method according to claim 1, wherein the overload power ($P_{OVER}$) and/or the period ($\Delta t$) depend on at least one maximum temperature ($T_{MAX}$).

5. The method according to claim 1, wherein the maximum temperature ($T_{MAX}$) depends on the properties of the at least one electric or electronic component of the cooking device.

6. The method according to claim 1, wherein the overload power ($P_{OVER}$) is limited by an extended maximum power ($P_{EXMAX}$).

7. The method according to claim 1, wherein the period ($\Delta t$) is limited by a maximum period ($\Delta t_{MAX}$).

8. The method according to claim 1, wherein a minimum period ($\Delta t_{MIN}$) between the step of deactivating the overload power ($P_{OVER}$) and a later step of activating an overload power ($P_{OVER}$) again is provided.

9. A computer program product stored on a computer usable medium, comprising computer readable program means for causing a computer to perform a method according to any one of the preceding claims 1 to 8.

10. An apparatus for controlling a cooking device, in particular an induction hob, which apparatus is provided for:

activating an overload power ($P_{OVER}$) for at least one electric or electronic component of the cooking device by using at least two synchronized generators, which overload power ($P_{OVER}$) is greater than a standard maximum power ($P_{MAX}$), with the standard max power ($P_{MAX}$) being a function of the voltage source associated with the cooking device;

deactivating the overload power ($P_{OVER}$) after a predetermined period ($\Delta t$); and operating the cooking device at a power (P), which is at most the standard maximum power ($P_{MAX}$); wherein the standard maximum power ($P_{MAX}$) is provided for a permanent operation of the cooking device, the overload power ($P_{OVER}$) and/or the period ($\Delta t$) are determined by a function depending on at least the overload power ($P_{OVER}$) and the period ($\Delta t$), and no additional components are required during activation of the overload power ($P_{OVER}$).

11. The apparatus according to claim 10, wherein the apparatus is realized in hardware, software or a combination of hardware and software.

12. A method for controlling a cooking device, in particular an induction hob, which method comprises the following steps:

activating an overload power ($P_{OVER}$) for at least one electric or electronic component of the cooking device by using at least two synchronized generators, which overload power ($P_{OVER}$) is greater than a standard maximum power ($P_{MAX}$), with the standard max power ($P_{MAX}$) being a function of the voltage source associated with the cooking device, wherein no additional components are required during activation of the overload power ($P_{OVER}$);

deactivating the overload power ($P_{OVER}$) after a predetermined period ($\Delta t$) which is less than a ($\Delta t_{MAX}$), and operating the cooking device at a power (P), which is at most the standard maximum power ($P_{MAX}$), wherein the standard maximum power ($P_{MAX}$) is provided for a permanent operation of the cooking device and the overload power ($P_{OVER}$) and/or the period ($\Delta t$) are determined by a function depending on at least the overload power ($P_{OVER}$) and the period ($\Delta t$).

13. The method of claim 12, wherein each of the generators are high power generators.

14. The method of claim 12, wherein the operating step involves operating the cooking device at the power (P) for a minimum period of time ($\Delta t_{MIN}$), and further comprising:

reactivating an overload power ($P_{OVER}$); and deactivating the overload power ($P_{OVER}$) after a predetermined period ($\Delta t$).

15. A method for controlling a cooking device, in particular an induction hob, which method comprises the following steps:

activating an overload power ($P_{OVER}$) for at least one electric or electronic component of the cooking device by using at least two high power synchronized generators, which overload power ($P_{OVER}$) is greater than a standard maximum power ($P_{MAX}$), wherein no additional components are required during activation of the overload power ($P_{OVER}$);

deactivating the overload power ($P_{OVER}$) after a predetermined period ($\Delta t$); and operating the cooking device at a power (P), which is at most the standard maximum power ($P_{MAX}$) for a minimum period of time ($\Delta t_{MIN}$);

reactivating an overload power ($P_{OVER}$); and deactivating the overload power ($P_{OVER}$) after a predetermined period ($\Delta t$), wherein the standard maximum power ($P_{MAX}$) is provided for a permanent operation of the cooking device and the overload power ($P_{OVER}$) and/or the period ($\Delta t$) are determined by a function depending on at least the overload power ($P_{OVER}$) and the period ($\Delta t$).

* * * * *